US007786938B2

(12) United States Patent
Sorvala et al.

(10) Patent No.: US 7,786,938 B2
(45) Date of Patent: Aug. 31, 2010

(54) ANTENNA, COMPONENT AND METHODS

(75) Inventors: Juha Sorvala, Oulu (FI); Petteri Annamaa, Oulunsalo (FI); Kimmo Koskiniemi, Oulu (FI)

(73) Assignee: Pulse Finland OY (FI)

( * ) Notice: Subject to any disclaimer, the term of this patent is extended or adjusted under 35 U.S.C. 154(b) by 483 days.

(21) Appl. No.: 11/648,429

(22) Filed: Dec. 28, 2006

(65) Prior Publication Data

US 2007/0171131 A1 Jul. 26, 2007

Related U.S. Application Data

(63) Continuation of application No. PCT/FI2005/050247, filed on Jun. 28, 2005.

(30) Foreign Application Priority Data

Jun. 28, 2004 (FI) ..... 20040892
Aug. 18, 2004 (FI) ..... 20041088
Mar. 16, 2005 (FI) ..... PCT/FI05/50089

(51) Int. Cl.
*H01Q 1/38* (2006.01)

(52) U.S. Cl. ..... 343/700 MS; 343/846

(58) Field of Classification Search ..... 343/700 MS, 343/702, 846, 829
See application file for complete search history.

(56) References Cited

U.S. PATENT DOCUMENTS 4,069,483 A 1/1978 Kaloi
5,278,528 A 1/1994 Turunen
5,382,959 A 1/1995 Pett et al.

(Continued)

FOREIGN PATENT DOCUMENTS

DE 101 50 149 A1 4/2003

(Continued)

OTHER PUBLICATIONS

"A Novel Approach of a Planar Multi-Band Hybrid Series Feed Network for Use in Antenna Systems Operating at Millimeter Wave Frequencies," by M.W. Elsallal and B.L. Hauck, Rockwell Collins, Inc., pp. 15-24, waelsall@rockwellcollins.com and blhauck@rockwellcollins.com.

(Continued)

*Primary Examiner*—Tho G Phan
(74) *Attorney, Agent, or Firm*—Gazdzinski & Associates, PC

(57) ABSTRACT

An antenna component (and antenna) with a dielectric substrate and a plurality of radiating antenna elements on the surface of the substrate. In one embodiment, the plurality comprises two (2) elements, each of them covering one of the opposite heads and part of the upper surface of the device. The upper surface between the elements comprises a slot. The lower edge of one of the antenna elements is galvanically coupled to the antenna feed conductor on a circuit board, and at another point to the ground plane, while the lower edge of the opposite antenna element, or the parasitic element, is galvanically coupled only to the ground plane. The parasitic element obtains its feed through the electromagnetic coupling over the slot, and both elements resonate at the operating frequency. Omni-directionality is also achieved. Losses associated with the substrate are low due to the simple field image in the substrate.

51 Claims, 5 Drawing Sheets

U.S. PATENT DOCUMENTS

| | | | | |
|---|---|---|---|---|
| 5,432,489 | A | 7/1995 | Yrjola | |
| 5,557,292 | A | 9/1996 | Nygren et al. | |
| 5,764,190 | A | 6/1998 | Murch et al. | |
| 5,892,490 | A | 4/1999 | Asakura et al. | |
| 6,016,130 | A | 1/2000 | Annamaa | |
| 6,097,345 | A | 8/2000 | Walton | |
| 6,133,879 | A | 10/2000 | Grangeat et al. | |
| 6,140,973 | A | 10/2000 | Annamaa | |
| 6,147,650 | A | 11/2000 | Kawahata et al. | |
| 6,177,908 | B1 | 1/2001 | Kawahata et al. | |
| 6,185,434 | B1 | 2/2001 | Hagstrom | |
| 6,195,049 | B1 | 2/2001 | Kim et al. | |
| 6,246,368 | B1 | 6/2001 | Deming et al. | |
| 6,252,554 | B1 | 6/2001 | Isohatala | |
| 6,268,831 | B1 | 7/2001 | Sanford | |
| 6,323,811 | B1 | 11/2001 | Tsubaki et al. | |
| 6,326,921 | B1 | 12/2001 | Egorov et al. | |
| 6,404,394 | B1 | 6/2002 | Hill | |
| 6,549,167 | B1 | 4/2003 | Yoon | |
| 6,614,400 | B2 | 9/2003 | Egorov | |
| 6,650,295 | B2 | 11/2003 | Ollikainen et al. | |
| 6,683,573 | B2 | 1/2004 | Park | |
| 6,781,545 | B2 | 8/2004 | Sung | |
| 6,847,329 | B2 | 1/2005 | Ikegaya et al. | |
| 6,876,329 | B2 * | 4/2005 | Milosavljevic | 343/700 MS |
| 6,950,066 | B2 * | 9/2005 | Hendler et al. | 343/700 MS |
| 7,042,403 | B2 | 5/2006 | Colburn et al. | |
| 7,057,560 | B2 | 6/2006 | Erkocevic | |
| 7,136,019 | B2 | 11/2006 | Mikkola et al. | |
| 7,148,849 | B2 | 12/2006 | Lin | |
| 7,148,851 | B2 | 12/2006 | Takaki et al. | |
| 7,180,455 | B2 | 2/2007 | Oh et al. | |
| 7,205,942 | B2 | 4/2007 | Wang et al. | |
| 7,218,282 | B2 | 5/2007 | Humpfer et al. | |
| 7,224,313 | B2 | 5/2007 | McKinzie, III et al. | |
| 7,274,334 | B2 | 9/2007 | O'Riordan et al. | |
| 7,289,064 | B2 | 10/2007 | Cheng | |
| 7,330,153 | B2 | 2/2008 | Rentz | |
| 7,333,067 | B2 | 2/2008 | Hung et al. | |
| 7,339,528 | B2 | 3/2008 | Wang et al. | |
| 7,345,634 | B2 | 3/2008 | Ozkar et al. | |
| 7,352,326 | B2 | 4/2008 | Korva | |
| 7,358,902 | B2 | 4/2008 | Erkocevic | |
| 7,385,556 | B2 | 6/2008 | Chung et al. | |
| 7,423,592 | B2 | 9/2008 | Pros et al. | |
| 7,439,929 | B2 | 10/2008 | Ozkar | |
| 2002/0019247 | A1 | 2/2002 | Egorov | |
| 2002/0145569 | A1 | 10/2002 | Onaka | |
| 2002/0163470 | A1 | 11/2002 | Nagumo et al. | |
| 2002/0196192 | A1 | 12/2002 | Nagumo et al. | |
| 2003/0020659 | A1 | 1/2003 | Kushihi | |
| 2003/0092420 | A1 | 5/2003 | Sugimoto et al. | |
| 2003/0222827 | A1 | 12/2003 | Sung | |
| 2004/0080457 | A1 | 4/2004 | Guo et al. | |
| 2004/0090366 | A1 | 5/2004 | Wong et al. | |
| 2004/0090378 | A1 | 5/2004 | Dai et al. | |
| 2004/0090382 | A1 | 5/2004 | Kushihi et al. | |
| 2004/0130493 | A1 | 7/2004 | Horita et al. | |
| 2004/0178957 | A1 | 9/2004 | Chang et al. | |
| 2005/0024268 | A1 | 2/2005 | McKinzie et al. | |
| 2005/0024272 | A1 | 2/2005 | Ponce De Leon et al. | |
| 2005/0057401 | A1 | 3/2005 | Yuanzhu | |
| 2005/0078037 | A1 | 4/2005 | Leclerc et al. | |
| 2005/0110692 | A1 | 5/2005 | Andersson | |
| 2005/0243001 | A1 | 11/2005 | Miyata et al. | |
| 2006/0071857 | A1 | 4/2006 | Pelzer | |
| 2006/0145924 | A1 | 7/2006 | Chen et al. | |
| 2006/0214857 | A1 | 9/2006 | Ollikainen | |
| 2007/0013589 | A1 | 1/2007 | Park et al. | |
| 2007/0109202 | A1 | 5/2007 | Vance | |
| 2007/0115177 | A1 | 5/2007 | Kawahata et al. | |
| 2007/0139277 | A1 | 6/2007 | Nissinen | |
| 2007/0152881 | A1 | 7/2007 | Chan | |
| 2007/0152885 | A1 * | 7/2007 | Sorvala | 343/700 MS |
| 2007/0152887 | A1 | 7/2007 | Castany et al. | |
| 2007/0171131 | A1 | 7/2007 | Sorvala | |
| 2007/0268190 | A1 | 11/2007 | Huynh | |
| 2007/0290938 | A1 | 12/2007 | Loyet | |
| 2008/0007459 | A1 | 1/2008 | Koskiniemi | |
| 2008/0042903 | A1 | 2/2008 | Cheng | |
| 2008/0088511 | A1 | 4/2008 | Sorvala | |
| 2008/0204328 | A1 | 8/2008 | Nissinen | |
| 2008/0284661 | A1 * | 11/2008 | He | 343/700 MS |
| 2008/0316116 | A1 * | 12/2008 | Hobson et al. | 343/702 |
| 2009/0135066 | A1 | 5/2009 | Raappana | |

FOREIGN PATENT DOCUMENTS

| | | | |
|---|---|---|---|
| EP | 0 332 139 | | 9/1989 |
| EP | 0 766 341 | | 2/1997 |
| EP | 0 766 340 | | 4/1997 |
| EP | 0 831 547 | A2 | 3/1998 |
| EP | 1 294 048 | | 1/1999 |
| EP | 0 942 488 | A2 | 9/1999 |
| EP | 1 003 240 | A2 | 5/2000 |
| EP | 1 052 723 | | 11/2000 |
| EP | 1 063 722 | A2 | 12/2000 |
| EP | 1 102 348 | | 5/2001 |
| EP | 1 113 524 | | 7/2001 |
| EP | 1 128 466 | A2 | 8/2001 |
| EP | 1 139 490 | | 10/2001 |
| EP | 1 146 589 | | 10/2001 |
| EP | 1 162 688 | | 12/2001 |
| EP | 1 248 316 | | 9/2002 |
| EP | 1 267 441 | | 12/2002 |
| EP | 1 351 334 | | 8/2003 |
| EP | 1 361 623 | | 11/2003 |
| EP | 1 406 345 | | 4/2004 |
| EP | 1 414 108 | | 4/2004 |
| EP | 1 432 072 | | 6/2004 |
| EP | 1 437 793 | | 7/2004 |
| EP | 1 469 549 | | 10/2004 |
| EP | 1 498 984 | | 1/2005 |
| EP | 1 544 943 | | 6/2005 |
| EP | 1 791 213 | | 5/2007 |
| JP | 10 028013 | | 1/1998 |
| JP | 10 209733 | | 8/1998 |
| JP | 11 068456 | | 3/1999 |
| JP | 2002319811 | A | 10/2002 |
| JP | 2004112028 | | 4/2004 |
| JP | 2004363859 | | 12/2004 |
| JP | 2005252661 | | 9/2005 |
| KR | 10-2006-7027462 | | 12/2002 |
| WO | WO 1998/37592 | | 8/1998 |
| WO | WO 00/36700 | | 6/2000 |
| WO | WO 01/28035 | | 4/2001 |
| WO | WO 01/33665 | | 5/2001 |
| WO | WO 02/11236 | A1 | 2/2002 |
| WO | WO 02/078123 | | 10/2002 |
| WO | WO 2004/070872 | | 8/2004 |
| WO | WO 2004/100313 | | 11/2004 |
| WO | WO 2004/112189 | A | 12/2004 |
| WO | WO 2004112189 | A1 * | 12/2004 |
| WO | WO 2005/018045 | | 2/2005 |
| WO | WO 2005/038981 | A1 | 4/2005 |
| WO | WO 2005/055364 | | 6/2005 |
| WO | WO 2006/000631 | A1 | 1/2006 |
| WO | WO 2006/000650 | | 1/2006 |
| WO | WO 2006/051160 | A1 | 5/2006 |
| WO | WO 2006/084951 | A1 | 8/2006 |
| WO | WO 2006/097567 | | 9/2006 |
| WO | WO 2007/000483 | A1 | 1/2007 |
| WO | WO 2007/012697 | | 2/2007 |
| WO | WO 2007/039667 | | 4/2007 |

| | | |
|---|---|---|
| WO | WO 2007/039668 | 4/2007 |
| WO | WO 2007/042615 | 4/2007 |
| WO | WO 2007/138157 | 12/2007 |

OTHER PUBLICATIONS

Wong, K., et al.; "A Low-Profile Planar Monopole Antenna for Multiband Operation of Mobile Handsets"; IEEE Transactions on Antennas and Propagation, Jan. 2003, vol. 51, No. 1.

Jing, X., et al.; "Compact Planar Monopole Antenna for Multi-Band Mobile Phones"; Microwave Conference Proceedings, 4.-7.12.2005. APMC 2005, Asia-Pacific Conference Proceedings, vol. 4.

Wang, H.; "Dual-Resonance Monopole Antenna with Tuning Stubs"; IEEE Proceedings, Microwaves, Antennas & Propagation, vol. 153, No. 4, Aug. 2006; pp. 395-399.

O. Kivekäs, et al.; "Frequency-tunable internal antenna for mobile phones", Proceedings of 12émes Journëes Internationales de Nice sur les Antennes, 12$^{th}$ Int'l Symposium on Antennas (JINA 2002), vol. 2, 2002, Nice, France, s.53-56, tiivistelmä.

"A 13.56MHz RFID Device and Software for Mobile Systems", by H. Ryoson, et al., Micro Systems Network Co., 2004 IEEE, pp. 241-244.

* cited by examiner

ANTENNA, COMPONENT AND METHODS

PRIORITY AND RELATED APPLICATIONS

This application is a continuation of and claims priority to International PCT Application No. PCT/F12005/050247 having an international filing date of Jun. 28, 2005, which claims priority to Finland Patent Application No. 20040892 filed Jun. 28, 2004, and also to Finland Patent Application No. 20041088 filed Aug. 18, 2004, each of the foregoing incorporated herein by reference in its entirety. This application also claims priority to PCT Application No. PCT/F12005/050089 having an international filing date of Mar. 16, 2005, also incorporated herein by reference in its entirety.

This application is related to co-owned and co-pending U.S. patent application Ser. No. 11/544,173 filed Oct. 5, 2006 and entitled "Multi-Band Antenna With a Common Resonant Feed Structure and Methods", and co-owned and co-pending U.S. patent application Ser. No. 11/603,511 filed Nov. 22, 2006 and entitled "Multiband Antenna Apparatus and Methods", each also incorporated herein by reference in its entirety. This application is also related to co-owned and co-pending U.S. patent application Ser. No. 11/648,431 filed contemporaneously herewith and entitled "Chip Antenna Apparatus and Methods", also incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention

The invention relates generally to antennas for radiating and/or receiving electromagnetic energy, and specifically in one aspect to a component, where conductive coatings of a dielectric substrate function as radiators of an antenna. The invention also relates to an antenna made by using such a component.

2. Description of Related Technology

In small-sized radio devices, such as mobile phones, the antenna or antennas are preferably placed inside the cover of the device, and naturally the intention is to make them as small as possible. An internal antenna has usually a planar structure so that it includes a radiating plane and a ground plane below it. There is also a variation of the monopole antenna, in which the ground plane is not below the radiating plane but farther on the side. In both cases, the size of the antenna can be reduced by manufacturing the radiating plane on the surface of a dielectric chip instead of making it air insulated. The higher the dielectricity of the material, the smaller the physical size of an antenna element of a certain electric size. The antenna component becomes a chip to be mounted on a circuit board. However, such a reduction of the size of the antenna entails the increase of losses and thus a deterioration of efficiency.

FIG. 1 shows an antenna component known from the publications EP 1 162 688 and U.S. Pat. No. 6,323,811, in which component there are two radiating elements side by side on the upper surface of the dielectric substrate 110. The first element 120 is connected by the feed conductor 141 to the feeding source, and the second element 130, which is a parasitic element, by a ground conductor 143 to the ground. The resonance frequencies of the elements can be arranged to be a little different in order to widen the band. The feed conductor and the ground conductor are on a lateral surface of the dielectric substrate. On the same lateral surface, there is a matching conductor 142 branching from the feed conductor 141, which matching conductor is connected to the ground at one end. The matching conductor extends so close to the ground conductor 143 of the parasitic element that there is a significant coupling between them. The parasitic element 130 is electromagnetically fed through this coupling. The feed conductor, the matching conductor and the ground conductor of the parasitic element together form a feed circuit; the optimum matching and gain for the antenna can then be found by shaping the strip conductors of the feed circuit. Between the radiating elements, there is a slot 150 running diagonally across the upper surface of the substrate, and at the open ends of the elements, i.e. at the opposite ends as viewed from the feeding side, there are extensions reaching to the lateral surface of the substrate. By means of such design, as well by the structure of the feed circuit, it is aimed to arrange the currents of the elements to be orthogonal so that the resonances of the elements would not weaken each other.

A drawback of the above described antenna structure is that in spite of the optimization of the feed circuit, waveforms that increase the losses and are useless with regard to the radiation are created in the dielectric substrate. The efficiency of the antenna is thus not satisfactory. In addition, the antenna leaves room for improvement if a relatively even radiation pattern, or omnidirectional radiation, is required.

SUMMARY OF THE INVENTION

The present invention addresses the foregoing needs by disclosing antenna component apparatus and methods.

In a first aspect of the invention, an antenna is disclosed. In one embodiment, the antenna comprises: a dielectric element having a longitudinal direction and a transverse direction, the element being deposited at least partially on a ground plane disposed on a substrate; a conductive coating deposited on the dielectric element, the conductive coating having a first portion forming a first resonator and a second portion forming a second resonator; and a feed structure coupled to the conductive coating. In one variant, open ends of the first resonator and the second resonator are separated by a non-conductive slot to at least electromagnetically couple the first resonator and the second resonator, and to form a resonant structure with the substrate and the ground plane.

In another embodiment, the antenna is manufactured according to the method comprising: mounting a dielectric element at least partially on a ground plane disposed on a substrate; disposing a conductive coating as a first portion and a second portion on the dielectric element; disposing a feed structure coupled to at least one of the first portion and the second portion; and forming a non-conductive slot coupled between the first portion and the second portion.

In yet another embodiment, the antenna comprises a high-efficiency antenna resulting from use of an antenna component that is comparatively simple in structure, and which allows for an uncomplicated current distribution within the antenna elements, and correspondingly a simple field image in the substrate without superfluous or ancillary waveforms.

In a second aspect of the invention, a radio frequency device is disclosed. In one embodiment, the device comprises: an antenna deposited substantially on a dielectric substrate having a longitudinal direction and a transverse direction; a conductive coating deposited on the dielectric substrate, the conductive coating having a first portion that forms a first resonator and a second portion that forms a second resonator, the first resonator and the second resonator separated at open ends by a non-conductive slot to provide frequency tuning; a feed structure coupled to the conductive coating; and a resonant structure formed by the first resonator, the second resonator, the substrate, and a ground plane deposited on the substrate and configured to operate within a selected frequency band.

In another embodiment, the device comprises a substrate; a conductive surface adapted to form a ground plane; an antenna comprising a dielectric element having a longitudinal direction and a transverse direction, the element being deposited at least partially on the ground plane; a conductive coating deposited on the dielectric element, the conductive coating having a first portion forming a first resonator and a second portion forming a second resonator; and a feed structure coupled to the conductive coating. Open ends of the first resonator and the second resonator are separated by a non-conductive slot to at least electromagnetically couple the first resonator and the second resonator, and to form a resonant structure with the substrate and the ground plane.

In a third aspect of the invention, a method for tuning an antenna is disclosed. In one embodiment, the antenna is disposed on a substrate, and the method comprises: setting an electrical length of a first conductive element between the first portion of a first radiating element and a ground plane; setting an electrical length of a second conductive element between the second portion of a second radiating element to the ground plane to achieve frequency tuning of the antenna; setting at least one of a feed structure length or connection point to the first portion of the radiating element; and setting at least one dimension of the ground plane to adjust an omni-directional antenna radiation pattern. In one variant, the first portion and the second portion are separated by a non-conductive slot so as to form a resonant structure, the resonant structure having an operating frequency determined at least in part by a dimension of the non-conductive slot.

In another embodiment, both the tuning and the matching of the antenna is carried out without discrete components; i.e., by shaping the conductor pattern of the circuit board near the antenna component.

In a fourth aspect of the invention, an antenna is disclosed comprising an antenna component. In one embodiment, the component comprises a dielectric substrate and a conductive layer that is at least partially coupled to a ground plane, the conductive layer partitioned at least in part by a non-conductive slot. In one variant, the non-conductive slot forms at least in part a first radiating element and a second radiating element, the first and the second radiating elements having an effective electrical length being related at least in part to a dimension of the non-conductive slot. A resonant structure is formed substantially based on the first radiating element, the second radiating element, the non-conductive slot, the ground plane proximate to the antenna component, and location of at least one feed point connection of at least one of the first radiating element and the second radiating elements, so to provide a substantially omni-directional radiation pattern during use.

In a fifth aspect of the invention, an antenna component for implementing an antenna of a radio device is disclosed. In one embodiment, the antenna component comprises: a dielectric element having an upper surface and a lower surface, a first and a second head, and a first and a second side; a first antenna element disposed substantially on a surface of the dielectric element and adapted to be connected to a feed conductor of the antenna at a first point, and to a ground plane of the radio device at a second point, the first antenna element comprising the first head and a first portion of the upper surface; a second antenna element disposed substantially on a surface of the dielectric element and adapted to be connected to the ground plane at a third point, the second antenna element comprising the second head and a second portion of the upper surface; and a slot formed between the first portion and the second portion of the upper surface to couple electromagnetic energy between the first antenna element and the second antenna element. In one variant, the first and second points are formed on the lower surface of the dielectric element proximate to an edge of the first head; and the third point is formed on the lower surface of the substrate proximal to an edge of the second head.

In a sixth aspect of the invention, an antenna component for implementing an antenna of a radio device is disclosed. In one embodiment, the component comprises: a first and a second antenna element; and a dielectric substrate with an upper and lower surface, a first and a second head, and a first and a second side. The first antenna element is located on at least one of the upper and lower surfaces of the substrate, and is arranged to be connected to feed conductor of the antenna at a first point, and to ground plane of the radio device at a second point, and the second antenna element is located on at least one of the upper and lower surfaces of the substrate, and is arranged to be connected to the ground plane at a third point.

In another embodiment, the antenna component is produced by the method comprising using of a semiconductor technique; i.e., by growing a metal layer on the surface of the substrate (e.g. quartz substrate), and removing a part of it so that the elements remain.

BRIEF DESCRIPTION OF THE DRAWINGS

In the following, the invention will be described in more detail. Reference will be made to the accompanying drawings, in which.

DETAILED DESCRIPTION OF THE INVENTION

Reference is now made to the drawings wherein like numerals refer to like parts throughout.

As used herein, the terms "wireless", "radio" and "radio frequency" refer without limitation to any wireless signal, data, communication, or other interface or radiating component including without limitation Wi-Fi, Bluetooth, 3G (3GPP/3GPPS), HSDPA/HSUPA, TDMA, CDMA (e.g., IS-95A, WCDMA, etc.), FHSS, DSSS, GSM, UMTS, PAN/802.15, WiMAX (802.16), 802.20, narrowband/FDMA, OFDM, PCS/DCS, analog cellular, CDPD, satellite systems, millimeter wave, or microwave systems.

Figure 2:
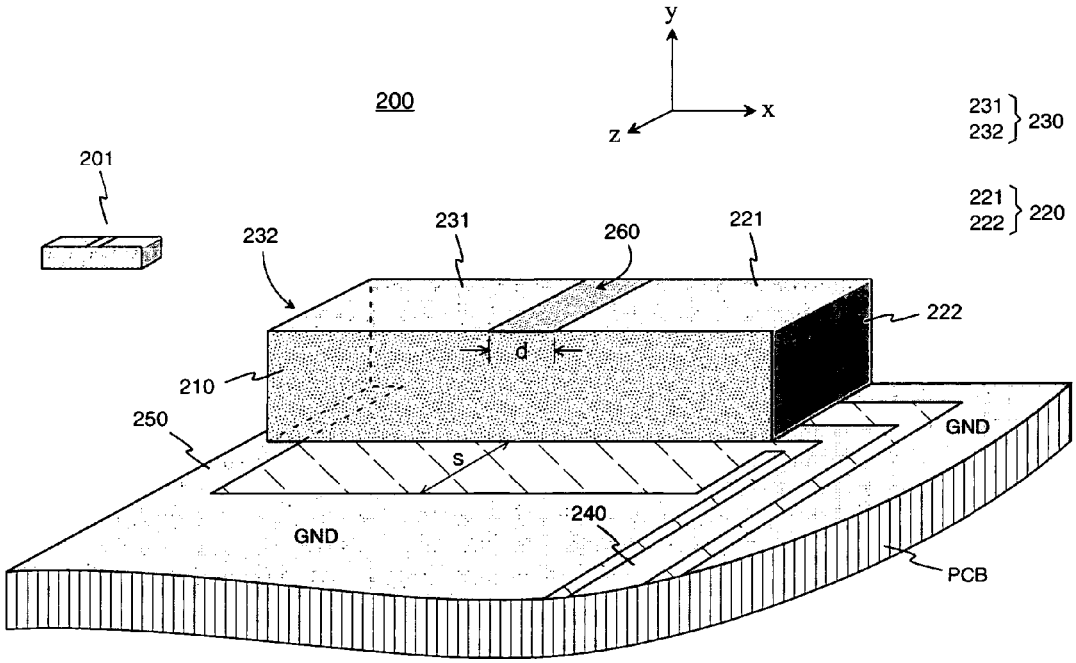
FIG. 2 presents an example of an antenna component and an antenna according to the invention.
Figure 5A:
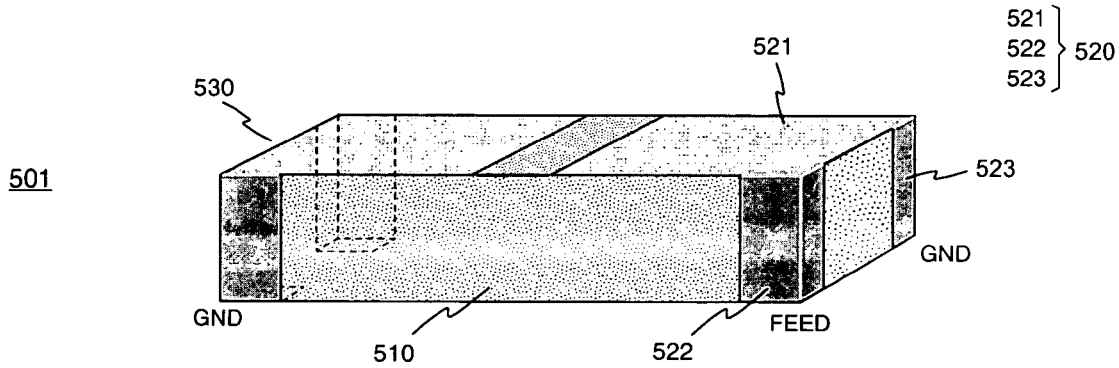
FIGS. 5*a* and 5*b* present an example of an antenna component according to the invention.

Additionally, it will be appreciated that as used herein, the qualifiers "upper" and "lower" refer to the relative position of the antenna shown in FIGS. 2 and 5*a*, and have nothing to do with the position in which the devices are used, and in no way are limiting, but rather merely for convenient reference.

Overview

In one salient aspect, the present invention comprises an antenna component (and antenna formed therefrom) which overcomes the aforementioned deficiencies of the prior art.

Specifically, one embodiment of the invention comprises a plurality (e.g., two) radiating antenna elements on the surface of a dielectric substrate chip. Each of them substantially covers one of the opposing heads, and part of the upper surface of the chip. In the middle of the upper surface between the elements is formed a narrow slot. The lower edge of one of the antenna elements is galvanically coupled to the antenna feed conductor on the circuit board, and at another point to the ground plane, while the lower edge of the opposite antenna element, or the parasitic element, is galvanically coupled only to the ground plane. The parasitic element obtains its feed through the electromagnetic coupling over the slot, and both elements resonate with substantially equally strength at the designated operating frequency.

In one embodiment, the aforementioned component is manufactured by a semiconductor technique; e.g., by growing a metal layer on the surface of quartz or other type of substrate, and removing a part of it so that the elements remain.

The antenna component disclosed herein has as one marked advantage a very small size. This is due primarily to the high dielectricity of the substrate used, and that the slot between the antenna elements is comparatively narrow. Also, the latter fact makes the "electric" size of the elements larger.

In addition, the invention has the advantage that the efficiency of an antenna made using such a component is high, in spite of the use of the dielectric substrate. This is due to the comparatively simple structure of the antenna, which produces an uncomplicated current distribution in the antenna elements, and correspondingly a simple field image in the substrate without "superfluous" waveforms.

Moreover, the invention has an excellent omnidirectional radiation profile, which is largely due to the symmetrical structure, shaping of the ground plane, and the nature of the coupling between the elements.

A still further advantage of the invention is that both the tuning and the matching of an antenna can be carried out without discrete components; i.e., just by shaping the conductor pattern of the circuit board near the antenna component.

DESCRIPTION OF EXEMPLARY EMBODIMENTS

Detailed discussions of various exemplary embodiments of the invention are now provided. It will be recognized that while described in terms of particular applications (e.g., mobile devices including for example cellular telephones), materials, components, and operating parameters (e.g., frequency bands), the various aspects of the invention may be practiced with respect to literally any wireless or radio frequency application.

Figure 1:
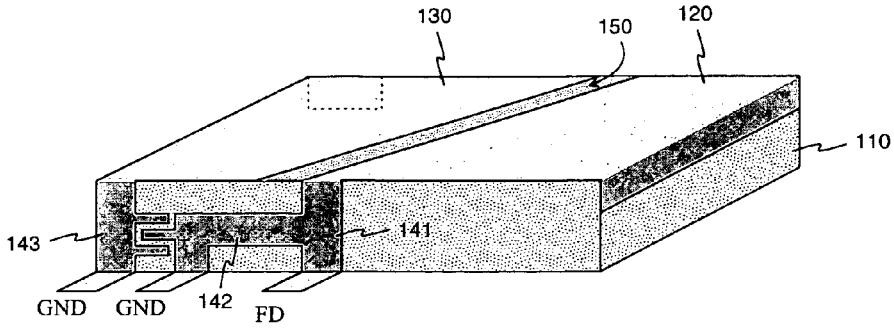
Fig. 1 PRIOR ART
FIG. 1 presents an example of a prior art antenna component.

FIG. 2 shows an example of an antenna component and a whole antenna according to the invention. The antenna component 201 comprises a dielectric substrate and a plurality (two in this embodiment, although other numbers are possible) antenna elements on its surface, one of which has been connected to the feed conductor of the antenna, and the other which is an electromagnetically fed parasitic element, somewhat akin to that of the antenna of FIG. 1. However, there are several structural and functional differences between those antenna components. In the antenna component according to the present invention, among other things, the slot separating the antenna elements is between the open ends of the elements and not between the lateral edges.

Moreover, the parasitic element gets its feed through the coupling prevailing over the slot, and not through the coupling between the feed conductor and the ground conductor of the parasitic element. The first antenna element 220 of the antenna component 201 comprises a portion 221 partly covering the upper surface of an elongated, rectangular substrate 210 and a head portion 222 covering one head of the substrate. The second radiating element comprises a portion 231 symmetrically covering a part of the substrate upper surface and a head portion 232 covering the opposite head. Each head portion 222 and 232 continues slightly on the side of the lower surface of the substrate, thus forming the contact surface of the element for its connection. In the middle of the upper surface between the elements there remains a slot 260, over which the elements have an electromagnetic coupling with each other. In the illustrated example, the slot 260 extends in the transverse direction of the substrate perpendicularly from one lateral surface of the substrate to the other, although this is by no means a requirement for practicing the invention.

In FIG. 2 the antenna component 201 is located on the circuit board PCB on its edge and its lower surface against the circuit board. The antenna feed conductor 240 is a strip conductor on the upper surface of the circuit board, and together with the ground plane, or the signal ground GND, and the circuit board material it forms a feed line having a certain impedance. The feed conductor 240 is galvanically coupled to the first antenna element 220 at a certain point of its contact surface. At another point of the contact surface, the first antenna element is galvanically coupled to the ground plane GND. At the opposite end of the substrate, the second antenna element 230 is galvanically coupled at its contact surface to the ground conductor 250, which is an extension of the wider ground plane GND. The width and length of the ground conductor 250 have a direct effect on the electric length of the second element and thereby on the natural frequency of the whole antenna. For this reason, the ground conductor can be used as a tuning element for the antenna.

The tuning of the antenna of the illustrated embodiment is also influenced by the shaping of the other parts of the ground plane, too, and the width d of the slot 260 between the antenna elements. There is no ground plane under the antenna component 201, and on the side of the component the ground plane is at a certain distance s from it. The longer the distance, the lower the natural frequency. Also reducing the slot width d lowers the antenna natural frequency. The distance s has an effect on the impedance of the antenna also. Therefore, the antenna can advantageously be matched by finding the optimum distance of the ground plane from the long side of the component. In addition, removing the ground plane from the side of the component improves the radiation characteristics of the antenna, such as its omnidirectional radiation. When the antenna component is located on the inner area of the circuit board, the ground plane is removed from its both sides.

At the operating frequency, both antenna elements together with the substrate, each other and the ground plane form a quarter-wave resonator. Due to the above-described structure, the open ends of the resonators are facing each other, separated by the slot 260, and the electromagnetic coupling is clearly capacitive. The width of the slot d can be dimensioned so that the dielectric losses of the substrate are minimized. One optimum width is, for example, 1.2 mm and a suitable range of variation 0.8-2.0 mm, for example. When a ceramic substrate is used, this structure provides a very small size. The dimensions of a component of an exemplary Bluetooth antenna operating on the frequency range 2.4 GHz are 2×2×7 $mm^3$, for example, and those of a component of a GPS (Global Positioning System) antenna operating at the frequency of 1575 MHz are 2×3×10 $mm^3$, for example. On the other hand, the slot width can be made very small, further to reduce the component size. When the slot becomes narrower, the coupling between the elements strengthens, of course, which strengthening increases their electric length and thus lowers the natural frequency of the antenna. This means that a component functioning in a certain frequency range has then to be made smaller than in the case of a wider slot.

Figure 3A:
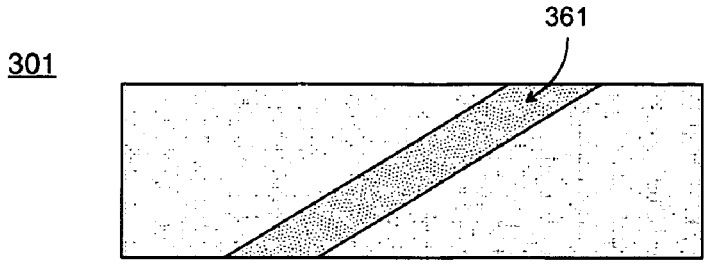
FIGS. 3*a-d* present examples of a shaping the slot between the antenna elements in the antenna component according to the invention.
Figure 3B:
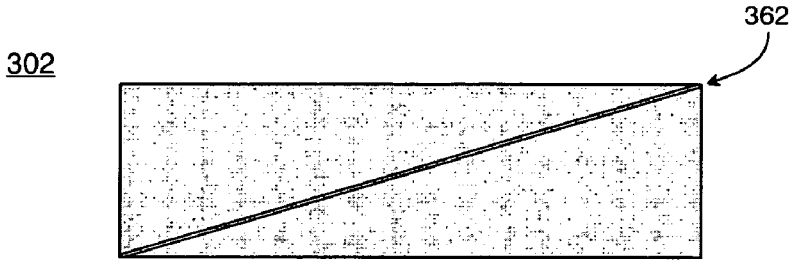

FIGS. 3*a-d* show examples of a shaping the slot between the antenna elements in the antenna component according to one embodiment of the invention. The antenna component is seen from above in each of the four drawings. In FIG. 3*a*, the slot 361 between the antenna elements of the antenna component 301 travels across the upper surface of the component, diagonally from the first side of the component to the second side. In FIG. 3*b*, the slot 362 between the antenna elements of the antenna component 302 as well travels diagonally across the upper surface of the component. The slot 362 is even more diagonal and thus longer than the slot 361, extending from a corner of the upper surface of the component to the opposite farthest corner. In addition, the slot 362 is narrower than the slot 361. Both factors have an affect, as previously explained, so that the operating band corresponding to the component 302 is located lower down than one corresponding to the component 301.

Figure 3C:
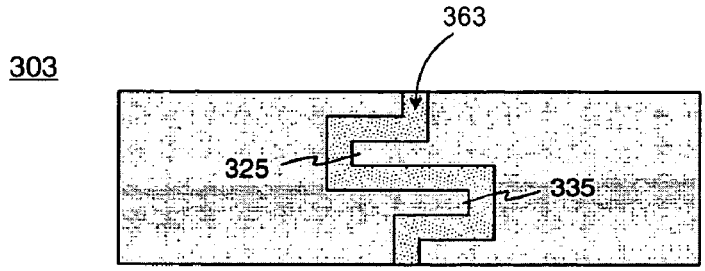
Figure 3D:
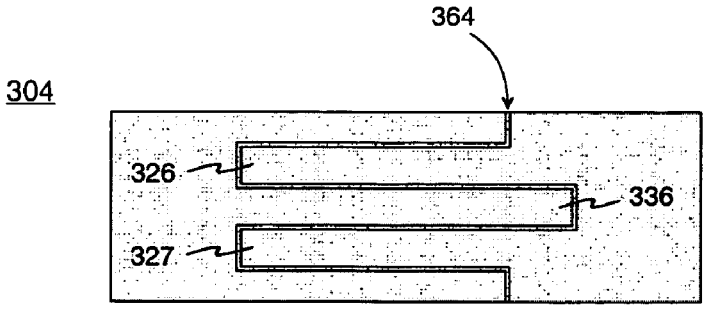

In FIG. 3*c*, the slot 363 between the antenna elements of the antenna component 303 has turns. The turns are rectangular in the illustrated embodiment, and the use of a number of them (e.g., six in this example) forms a finger-like strip 325 in the first antenna element, extending between the areas belonging to the second antenna element. Symmetrically, a finger-like strip 335 is formed in the second antenna element, extending between the areas belonging to the first antenna element. In FIG. 3*d* the slot 364 between the antenna elements of the antenna component 304 as well has turns. The number of the turns is greater than in the slot 363, so that two finger-like strips 326 and 327 are formed in the first antenna element, extending between the areas belonging to the second antenna element. Between these strips there is a finger-like strip 336 as an extension of the second antenna element. The strips in the elements of the component 304 are, besides being greater in number, also longer than the strips in the elements of the component 303, and the slot 364 is narrower than the slot 363 also. For these reasons, the operating band corresponding to the component 304 is located lower down than the operating band corresponding to the component 303.

When a very narrow slot between the antenna elements is desired, a semiconductor technique can be applied. In that case, the substrate is optimally chosen to be some basic material (e.g., wafers) used in the manufacturing process of semiconductor components, such as quartz, gallium-arsenide or silicon. A metal layer is grown on the surface of the substrate e.g. by a sputtering technique, and the layer is removed at the place of the intended slot by the exposure and etching technique well known in the manufacture of semiconductor components. This approach makes it possible to form a slot having 50 μm width, for example.

Figure 4:
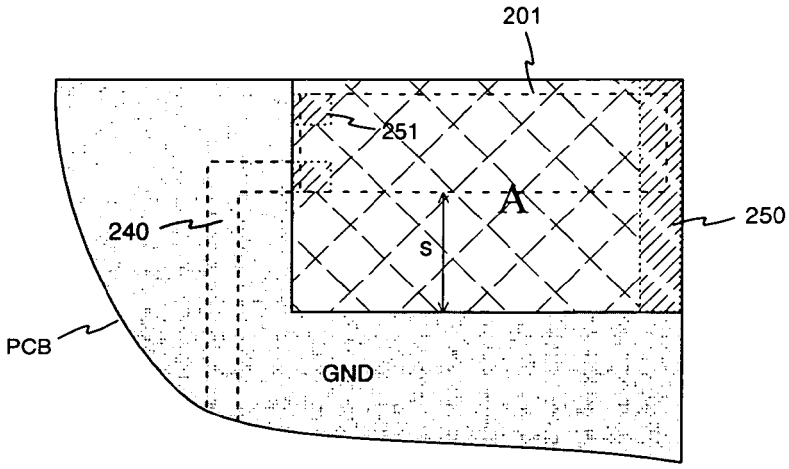
FIG. 4 presents a part of a circuit board belonging to the antenna of FIG. 2 from the reverse side.

FIG. 4 shows a part of the circuit board belonging to the antenna of FIG. 2, as seen from below. The antenna component 201 on the other side of the circuit board (e.g., PCB) has been marked with dashed lines in the drawing. Similarly with dashed lines are marked the feed conductor 240, the ground conductor 250 and a ground strip 251 extending under the component to its contact surface at the end on the side of the feed conductor. A large part of the lower surface of the circuit board belongs to the ground plane GND. The ground plane is missing from a corner of the board in the area A, which comprises the place of the component and an area extending to a certain distance s from the component, having a width which is the same as the length of the chip component.

FIG. 5*a* shows another example of the antenna component according to the invention. The component 501 is mainly similar to the component 201 presented in FIG. 2. The difference is that now the antenna elements extend to the lateral surfaces of the substrate 510 at the ends of the component, and the heads of the substrate are largely uncoated. Thus the first radiating element 520 comprises a portion 521 partly covering the upper surface of the substrate, a portion 522 in a corner of the substrate, and a portion 523 in another corner of the same end. The portions 522 and 523 in the corners are partly on the side of the lateral surface of the substrate, and partly on the side of the head surface. They continue slightly to the lower surface of the substrate, forming thus the contact surface of the element for its connection. The second antenna element 530 is similar to the first one and is located symmetrically with respect to it. The portions of the antenna elements being located in the corners can naturally also be limited only to the lateral surfaces of the substrate, or only to one of the lateral surfaces. In the latter case, the conductor coating running along the lateral surface continues at either end of the component under it for the whole length of the end.

Figure 5B:
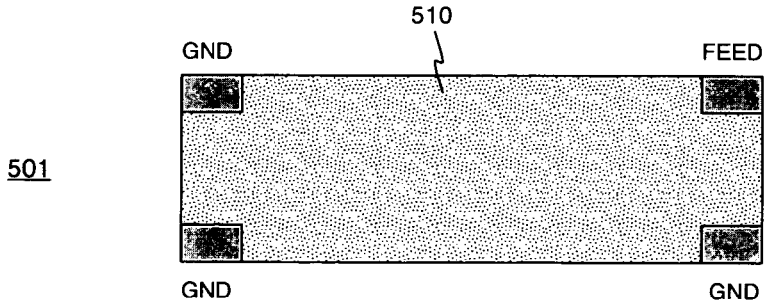

In FIG. 5*b*, the antenna component 501 of FIG. 5*a* is seen from below. The lower surface of the substrate 510 and the conductor pads serving as the contact surfaces in its corners are seen in the drawing. One of the conductor pads at the first end of the substrate is intended to be connected to the antenna feed conductor of the antenna and the other one to the ground plane GND. Both of the conductor pads at the second end of the substrate are intended to be coupled to the ground plane.

Figure 6:
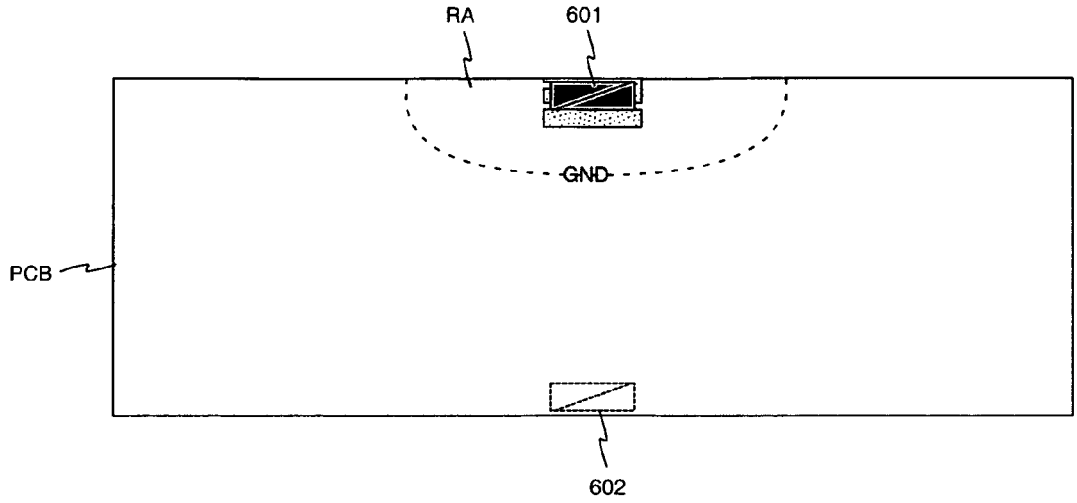
FIG. 6 presents an application of an antenna component according to the invention.

FIG. 6 shows an exemplary application of an antenna component according to the invention. In the drawing, an elongated antenna component 601 has been placed to the middle of one long side of the radio device circuit board PCB, in the direction of the circuit board. The antenna component is designed so that when it is fed, an oscillation is excited in the ground plane GND, the frequency of the oscillation being the same as the one of the feeding signal. In that case, the ground plane also functions as a useful radiator. A certain area RA round the antenna component radiates to significant degree. The antenna structure can comprise also several antenna components, as the component 602 drawn with dashed line in the Figure.

Figure 7:
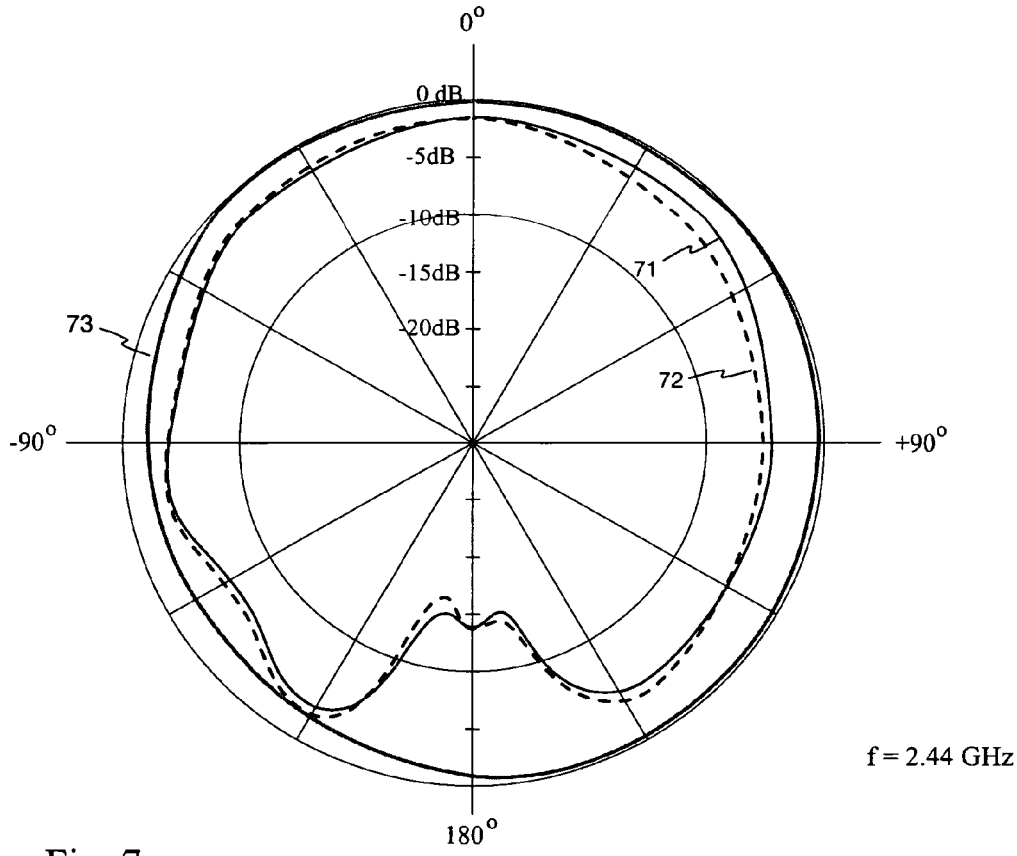
FIG. 7 presents an example of the directional characteristics of an antenna according to the invention, placed in a mobile phone.

FIG. 7 shows an example of the directional characteristics of an antenna according to one embodiment of the invention, being located in a mobile phone. The antenna has been designed for the Bluetooth system, although it will be recognized that the invention may be used in other wireless applications. There are three directional patterns in the Figure: (i) the directional pattern 71 presents the antenna gain on plane XZ, (ii) the directional pattern 72 on plane YZ, and (iii) the directional pattern 73 on plane XY; wherein the X axis is the longitudinal direction of the chip component, the Y axis is the vertical direction of the chip component, and the Z axis is the transverse direction of the chip component. It is seen from the patterns that the antenna transmits and receives well on all planes and in all directions. On the plane XY in particular, the pattern is especially even. The two others only have a recess of 10 dB in a sector about 45 degrees wide. The completely "dark" sectors typical in directional patterns do not exist at all.

Figure 8:
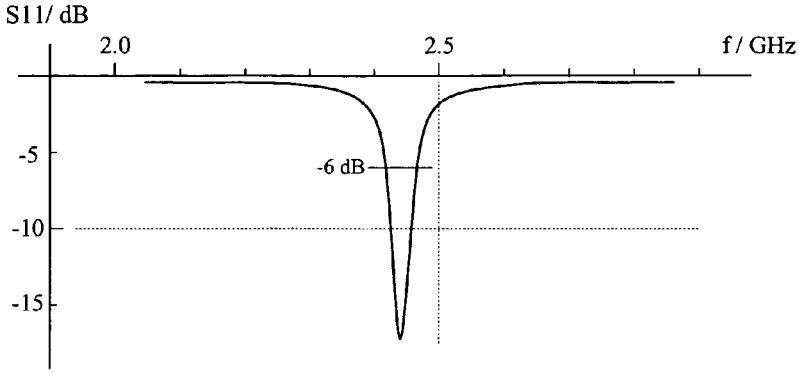
FIG. 8 shows an example of the matching of an antenna according to the invention.

FIG. 8 shows an example of the matching of an antenna according to the invention. It presents a curve of the reflection coefficient S11 as a function of frequency. The curve of FIG. 8 has been measured from the same Bluetooth antenna as the patterns of FIG. 7. If the criterion for the cut-off frequency used is the value −6 dB of the reflection coefficient, the bandwidth becomes about 50 MHz, which is about 2% as a relative value. In the center of the operating band, at the frequency of 2440 MHz, the reflection coefficient is −17 dB, which indicates good matching. The Smith diagram shows that in the center of the band, the impedance of the antenna is purely resistive, slightly inductive below the center frequency, and slightly capacitive above the center frequency, respectively.

Figure 9:
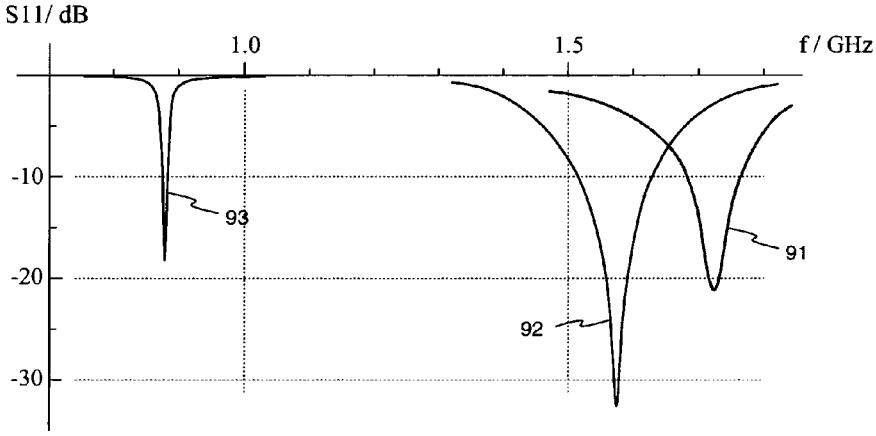
FIG. 9 shows an example of the influence of the shape of the slot between the antenna elements on the location of an antenna operating band.

FIG. 9 shows an example of the influence of the shape of the slot between the antenna elements on the location of an antenna operating band. The curve 91 shows the fluctuation of the reflection coefficient S11 as a function of frequency of an antenna comprising the antenna component, which has the size 10×3×4 $mm^3$ and a perpendicular slot between the antenna elements. The resonance frequency of the antenna, which is approximately the center frequency of the operating band, falls on the point at 1725 MHz.

The curve 92 shows the fluctuation of the reflection coefficient, when slot between the antenna elements is diagonal according to FIG. 3*b*. In other respects, the antenna is similar to that in the previous case. Now the resonance frequency of the antenna falls on the point 1575 MHz, the operating band thus being located 150 MHz lower than in the previous case. The exemplary frequency of 1575 MHz is used by the GPS (Global Positioning System). Using a diagonal slot, not much lower frequency can be achieved by the antenna in question, in practice.

The curve 93 shows the fluctuation of the reflection coefficient, when slot between the antenna elements is devious according to FIG. 3*d* and some narrower than in two previous cases. In other respects the antenna is similar. The antenna operating band is now located nearly half lower down than in the case corresponding to the curve 91. The resonance frequency falls on the point 880 MHz, which is in the range used by the EGSM-system (Extended GSM).

In the three cases of FIG. 9, a cream having a value of 20 for the relative dielectric constant $\in_r$ is used in the antenna. If a cream having higher $\in_r$-value will be used, the band of an antenna with a diagonal slot can be placed, e.g. in the range of 900 MHz, without making the antenna bigger. However, the electric characteristics of the antenna would then be somewhat reduced.

Figure 10:
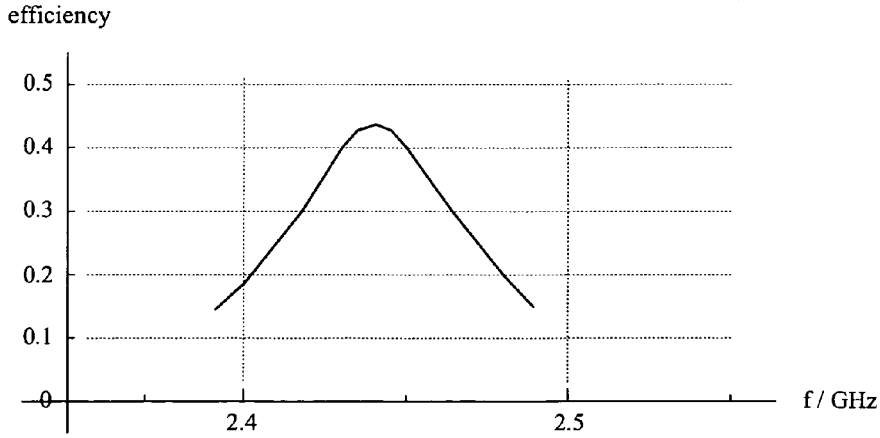
FIG. 10 presents an example of the efficiency of an antenna according to the invention.

FIG. 10 shows the efficiency of an exemplary antenna according to the invention. The efficiency has been measured from the same Bluetooth antenna as the patterns of FIGS. 7 and 8. At the center of the operating band of the antenna the efficiency is about 0.44, and decreases from that to the value of about 0.3 when moving 25 MHz to the side from the center of the band. The efficiency is considerably high for an antenna using a dielectric substrate.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An antenna manufactured according to the method comprising:

mounting a dielectric element at least partially on a ground plane disposed on a substrate;

disposing a conductive coating as a first portion and a second portion on the dielectric element;

disposing a feed structure coupled to at least one of the first portion and the second portion; and forming a non-conductive slot coupled between the first portion and the second portion;

wherein said first portion and said second portion are substantially symmetric with respect to each other.

2. The antenna of claim 1, wherein the act of forming the non-conductive slot comprises forming:

i.) a first resonator utilizing the first portion and a second resonator utilizing the second portion; and ii.) a resonant structure comprising a frequency resonance resulting from electromagnetic coupling of open ends of the first resonator and the second resonator over the non conductive slot and not between said feed and said first or second portion.

3. The antenna of claim 2, wherein the resonant structure comprises a quarter-wave resonator adapted to operate with a first frequency range.

4. The antenna of claim 2, wherein the ground plane is coupled to non-open ends of the first resonator and the second resonator to provide frequency tuning.

5. The antenna of claim 2, wherein forming a non-conductive slot comprises forming a capacitive element to couple electromagnetically the open ends of the first and the second resonators to decrease an operating frequency range of the antenna.

6. The antenna of claim 2, wherein forming a non-conductive slot comprises forming a substantially meandered slot across the dielectric substrate to increase a cross-sectional area that spans between the open ends of the first resonator and the second resonator.

7. The antenna of claim 2, further comprises coupling a distal end of the second resonator to the ground plane to produce a desired frequency response of the antenna.

8. The antenna of claim 2, wherein forming the non-conductive slot comprises forming a plurality of projections extending between the first resonator and the second resonator.

9. The antenna of claim 1, wherein disposing the feed structure comprises forming a conductive trace directly coupled to a first surface of the first portion and electromagnetically coupled to a second surface of the second portion.

10. The antenna of claim 1, wherein disposing the feed structure comprises connecting the feed structure to the first portion and coupling electromagnetic energy from the first portion to the second portion.

11. The antenna of claim 1, wherein the dielectric element comprises a ceramic material provided to at least partly insulate the antenna from the ground plane.

12. An antenna comprising:

a dielectric substrate having a longitudinal direction and a transverse direction;

a conductive coating deposited on the dielectric substrate, the conductive coating having a first portion that forms a first resonator and a second portion that forms a second resonator, the first resonator and the second resonator separated at open ends by a non-conductive slot to provide frequency tuning said first portion and said second portion having open sides free from said conductive coating; and a feed structure coupled to the conductive coating; and a resonant structure formed by the first resonator, the second resonator, the substrate, and a ground plane deposited on the substrate, the resonant structure configured to operate within a selected frequency band.

13. The antenna of claim 12, wherein the resonant structure comprises a quarter-wave resonator.

14. The antenna of claim 12, wherein the feed structure comprises a conductive trace directly coupled to a first surface of the first resonator, and electromagnetically coupled to a second surface of the second resonator.

15. The antenna of claim 12, wherein the ground plane comprises a conductive structure coupled to distally positioned surfaces of the first resonator and the second resonator.

16. The antenna of claim 12, wherein the feed structure comprises a conductive structure attached the first portion or the second portion.

17. The antenna of claim 12, wherein the non-conductive slot comprises a capacitance coupled to the open ends of the first and the second resonators.

18. The antenna of claim 12, wherein the dielectric element comprises a material selected from the group consisting of: ceramic, gallium arsenide, and silicon.

19. The antenna of claim 12, wherein the non-conductive slot comprises a substantially meandered slot extended across at least a portion of the dielectric substrate.

20. The antenna of claim 12, wherein the non-conductive slot comprises a substantially diagonal slot extended across at least a portion of the dielectric substrate.

21. The antenna of claim 12, wherein the non-conductive slot comprises a capacitance added between the open ends of the first resonator and the resonator, said capacitance allowing the physical dimensions of the first and the second resonators to be smaller than the dimensions of the first and second resonators without the capacitance.

22. The antenna of claim 12, wherein the second resonator comprises a connection point coupled to the ground plane and adapted to tune a frequency response of the antenna.

23. The antenna of claim 12, wherein the non-conductive slot comprises at least one projection extended along at least one edge of the first resonator and the second resonator.

24. An antenna comprising:

a dielectric element comprising:

an upper surface and a lower surface;

a first and a second head; and a first and a second side;

a first antenna element disposed substantially on a surface of the dielectric element and adapted to be connected to a feed conductor of the antenna at a first point, and to a ground plane of a radio device at a second point, the first antenna element comprising the first head and a first portion of the upper surface;

a second antenna element disposed substantially on a surface of the dielectric element and adapted to be connected to the ground plane at a third point, the second antenna element comprising the second head and a second portion of the upper surface; and a slot formed between the first portion and the second portion of the upper surface to couple electromagnetic energy between the first antenna element and the second antenna element;

wherein:

the first and second points are formed on the lower surface of the dielectric element proximate to an edge of the first head; and the third point is formed on the lower surface of the substrate proximate to an edge of the second head.

25. The antenna according to claim 24, wherein the first antenna element, the second antenna element, the dielectric element, and the ground plane form a quarter-wave resonator adapted to resonate at a specified operating frequency.

26. The antenna according to claim 24, wherein the first antenna element further comprises a first section of the first head covering at least a portion of an upper surface of the first antenna element, and the second antenna element further comprises a second section of the second head covering at least a portion of an upper surface of the second antenna element.

27. The antenna according to claim 24, wherein said slot comprises a slot formed laterally across the upper surface from the first side of the antenna component to the second side.

28. The antenna according to claim 24, wherein said slot comprises a slot travelling diagonally across the upper surface from the first side of the component to the second side.

29. The antenna according to claim 24, wherein said slot comprises at least one turn on the dielectric element.

30. The antenna according to claim 29, wherein the at least one turn is formed in at least one of the first and the second antenna elements as a projection extended between areas belonging to opposing ones of said antenna elements.

31. The antenna according to claim 24, wherein the slot comprises an opening less than or equal to 100 μm.

32. An antenna comprising:

a first and a second antenna element; and a dielectric substrate with an upper and lower surface, a first and a second head, and a first and a second open sides, wherein said first antenna element is located on at least one of said upper and lower surfaces of the substrate, and is arranged to be connected to feed conductor of the antenna at a first point, and to a ground plane of a radio device at a second point, and wherein said second antenna element is located on at least one of said upper and lower surfaces of the substrate, and is arranged to be connected to the ground plane at a third point;

wherein said first antenna element comprises a portion covering the first head and another portion covering the upper surface, and said second antenna element comprises a portion covering the second head and another portion covering the upper surface so that a slot remains between said elements, the slot extending from the first open side to the second open side, over which slot the second antenna element is arranged to obtain a feed electromagnetically; and wherein said first and second point are disposed at least partly on the lower surface of the substrate at the end on the side of its first head, and said third point is disposed at least partly on the lower surface of the substrate at the end on the side of its second head.

33. An antenna comprising:

a dielectric element having a first dimension and a second dimension, said element being deposited at least partially on a ground plane;

a conductive coating deposited on the dielectric element, the conductive coating having a first portion forming a first resonator and a second portion forming a second resonator;

wherein said first portion and said second portion are substantially symmetric with respect to each other;

a feed structure coupled to the conductive coating;

wherein open ends of the first resonator and the second resonator are separated by a non-conductive slot, formed substantially between the open ends of said first and second resonators and not between the lateral sides, so as to at least electromagnetically couple the first resonator and the second resonator, and to form a resonant structure with at least the ground plane.

34. The antenna of claim 33, wherein said ground plane is arranged a certain distance away from said dielectric element at least on one side.

35. An antenna manufactured according to the method comprising:

mounting a dielectric element at least partially on a ground plane disposed on a substrate;

disposing a conductive coating as a first portion and a second portion on the dielectric element, the disposing forming a non-conductive slot coupled between the first portion and the second portion; and disposing a feed structure coupled to at least one of the first portion and the second portion;

wherein said first portion and said second portion are substantially symmetric with respect to each other.

36. The antenna of claim 35, wherein the act of disposing comprises forming:

i.) a first resonator utilizing the first portion and a second resonator utilizing the second portion; and ii.) a resonant structure comprising a frequency resonance resulting from electromagnetic coupling of open ends of the first resonator and the second resonator over the non conductive slot and not between said feed and said first or second portion.

37. The antenna of claim 36, wherein the resonant structure comprises a quarter-wave resonator adapted to operate with a first frequency range.

38. The antenna of claim 36, further comprises coupling a distal end of the second resonator to the ground plane to produce a desired frequency response of the antenna.

39. The antenna of claim 36, wherein disposing the conductive coating comprises forming a plurality of projections extending between the first portion and the second portion.

40. The antenna of claim 35, wherein disposing the feed structure comprises forming a conductive trace directly coupled to a first surface of the first portion and electromagnetically coupled to a second surface of the second portion.

41. The antenna of claim 35, wherein the ground plane is coupled to non-open ends of the first portion and the second portion to enable frequency tuning.

42. The antenna of claim 35, wherein disposing the feed structure comprises connecting the feed structure to the first portion and coupling electromagnetic energy from the first portion to the second portion.

43. The antenna of claim 35, wherein said disposing a conductive coating comprises forming a capacitive element to couple electromagnetically the open ends of the first and the second portions to decrease an operating frequency range of the antenna.

44. The antenna of claim 35, wherein the dielectric element comprises a ceramic material provided to at least partly insulate the antenna from the ground plane.

45. An antenna comprising:

a dielectric substrate having a longitudinal direction and a transverse direction;

a conductive coating deposited on the dielectric substrate, the conductive coating having a first portion that forms part of a first resonator and a second portion that forms part of a second resonator, the first resonator and the second resonator separated at open ends by a non-conductive slot to provide frequency tuning said first portion and said second portion having open sides free from said conductive coating; and a feed structure coupled to the conductive coating; and a resonant structure formed by the conductive coating, the substrate, and a ground plane deposited on the substrate, the resonant structure configured to operate within a selected frequency band.

46. The antenna of claim 45, wherein the resonant structure comprises a quarter-wave resonator.

47. The antenna of claim 45, wherein the feed structure comprises a conductive trace directly coupled to a first surface of the first resonator, and electromagnetically coupled to a second surface of the second resonator.

48. The antenna of claim 45, wherein the ground plane comprises a conductive structure coupled to distally positioned surfaces of the first resonator and the second resonator.

49. The antenna of claim 45, wherein the feed structure comprises a conductive structure attached the first portion or the second portion.

50. The antenna of claim 45, wherein the non-conductive slot comprises a capacitance coupled to the open ends of the first and the second resonators.

51. The antenna of claim 45, wherein the dielectric element comprises a material selected from the group consisting of: ceramic, gallium arsenide, and silicon.

* * * * *